US006073093A

United States Patent [19]

Zinser, Jr.

[11] Patent Number: 6,073,093

[45] Date of Patent: Jun. 6, 2000

[54] COMBINED RESIDUAL AND ANALYSIS-BY-SYNTHESIS PITCH-DEPENDENT GAIN ESTIMATION FOR LINEAR PREDICTIVE CODERS

[75] Inventor: Richard Louis Zinser, Jr., Niskayuna, N.Y.

[73] Assignee: Lockheed Martin Corp., King of Prussia, Pa.

[21] Appl. No.: 09/172,503

[22] Filed: Oct. 14, 1998

[51] Int. Cl.[7] ..... G10L 11/04; G10L 19/12

[52] U.S. Cl. ..... 704/220; 704/219; 704/225

[58] Field of Search ..... 704/208, 219, 704/220, 225

[56] References Cited

U.S. PATENT DOCUMENTS

| | | | |
|---|---|---|---|
| 4,797,929 | 1/1989 | Gerson et al. | 704/243 |
| 4,905,288 | 2/1990 | Gerson et al. | 704/245 |
| 5,151,968 | 9/1992 | Tanaka et al. | 704/200 |
| 5,710,863 | 1/1998 | Chen | 704/230 |
| 5,790,759 | 8/1998 | Chen | 704/230 |

*Primary Examiner*—David R. Hudspeth
*Assistant Examiner*—Tálivaldis Ivars Šmits
*Attorney, Agent, or Firm*—W. H. Meise

[57] ABSTRACT

A vocoder transmitter (12) sends coded speech to a vocoder receiver (16) over a limited-bandwidth channel (14). The transmitter includes a LPC-residual-based first gain estimator (46), which gain value works well with women's voices, but less so with men's. A second, analysis-by-synthesis, gain estimator (42) therein, uses a unit-gain version (342) of the receiver's synthesizer, whose input (24) and output (310) speech power is estimated, to produce the second gain value from their ratio (312). The second gain value has been found to work well with men's voices, but to produce "explosive" artifacts with women's. A combiner (518) weights these two gain estimates, under control of the estimated pitch, to produce the vocoder gain estimate transmitted to the vocoder receiver (16). In a particular embodiment the first gain estimate predominates at low pitch periods, and the second gain estimate at higher ones, with crossover at about 45 sample lags for an 8000 Hz sampling rate.

2 Claims, 6 Drawing Sheets

$$\alpha = \frac{\text{PITCH}-\beta}{\beta} \Big]_{0.0}^{1.0}$$

$\beta \approx 30$

COMBINED RESIDUAL AND ANALYSIS-BY-SYNTHESIS PITCH-DEPENDENT GAIN ESTIMATION FOR LINEAR PREDICTIVE CODERS

FIELD OF THE INVENTION

This invention relates to transmission of speech signals using a vocoder, and more particularly to arrangements and methods for improving the perceived quality of such transmissions.

BACKGROUND OF THE INVENTION

There is always a need for more bandwidth in communications channels, to accommodate a larger number of users. The finite or limited availability of channel bandwidth, in turn, makes the efficient use of bandwidth an economic necessity. The transmission of speech signals over limited-bandwidth channels has been the subject of extensive investigation and improvement. These improvements have given rise to devices known in the art as vocoders. In general, vocoders include a transmitter which analyzes the voice signal to be transmitted, and extracts various characteristics of the speech. These characteristics are encoded in some fashion, and transmitted over the limited-bandwidth transmission channel to a vocoder receiver. The vocoder receiver receives the encoded signals, and reconstitutes the original voice signal.

The voice signals which are reconstituted by the vocoder receiver never include all of the information occurring in the original voice signal, because the bandwidth of the transmission channel is incapable of carrying all of the information in the original voice. Thus, the quality of the signal received at the output of a vocoder system depends in part upon the bandwidth of the channel over which the signal must be transmitted, and in part upon the efficiency or effectiveness with which the system analyzes and reconstitutes the voice within the available bandwidth.

Of necessity, there is a certain amount of distortion in transmission over a vocoder system, and this distortion is manifested as coding noise. Various schemes have been advanced for masking or reducing the amplitude or perceived amplitude of the coding noise, including the schemes described in U.S. patent applications filed on Jul. 13, 1998, Ser. No. 09/114,658 in the name of Grabb et al.; Ser. No. 09/114,661 in the name of Zinser et al. Ser. No. 09/114,662 in the name of Grabb et al.; Ser. No. 09/114,663 in the name of Zinser et al.; Ser. No. 09/114,664, in the name of Zinser et al.; and Ser. No. 09/114,659 in the name of Grabb et al. Related matter appears in copending applications Ser. Nos. 09/340,100, 09/340,101; and 09/340,102, filed Jun. 25, 1999 in the names of Ross et al; Van Stralen et al., and Ross et al., respectively. Among these schemes is one described in docket number RDMM25497, U.S. patent application Ser. No. 09/114,660, filed Jul. 13, 1998 in the name of Zinser et al., entitled SPEECH CODING SYSTEM AND METHOD INCLUDING VOICING CUT OFF FREQUENCY ANALYZER, in which the system gain is calculated using the root-mean-square (RMS) value of the linear predictive coding (LPC) residual according to $$\mathrm{RMS} = \sqrt{\frac{\sum_i r_i^2}{N}} \qquad 1$$

where $r_i$ are the residual samples, and N is the number of samples in a speech frame, which in one embodiment is 160 samples in a frame having duration of 20 msec. It was discovered that men's voices were not perceived as sounding as good as those of women after transmission of speech through the limited-bandwidth channel.

Improved vocoder arrangements are desired.

SUMMARY OF THE INVENTION

The invention generally relates to a vocoder transmitter which codes input speech signals for transmission over a limited-bandwidth channel to a vocoder receiver. The transmitter includes a first system gain estimator which produces a first estimated gain signal, which has been found to work well with women's voices, but less well with men's voices. The transmitter also includes an analysis-by-synthesis arrangement which contains, inter alia, a synthetic receiver which generates synthesized received signals which would be generated by the receiver if the receiver had unit gain. The power of the synthesized received signals is compared with the input speech power, and the ratio so formed represents a second estimate of the system gain. This second estimate has been found to work well with men's voices, but to produce "explosive" artifacts when used with women's voices. A combiner combines the first and second estimates of the system gain under control of the estimated pitch to produce the sum gain estimate which is transmitted to the vocoder receiver. In a particular embodiment of the invention, the first gain estimate predominates in the sum gain signal at low pitch periods, and the second gain estimate predominates at the higher pitch periods. In a particular embodiment, the crossover between higher and lower pitch frequencies is at about 45 sample lags. Typical sampling frequency is 8000 Hz.

A vocoder transmitter according to an aspect of the invention codes input speech signals arranged in sequential frames for transmission over a limited-bandwidth channel. The transmitter includes a pitch estimator coupled to receive the input speech signals, for generating pitch estimates representative of the pitch period of the input speech signals. A voicing estimator is coupled to receive the input speech signals, for generating estimates of the voicing cutoff frequency of the input speech signals. A spectrum analysis and quantization estimator is coupled to receive the input speech signals, for generating linear predictive coding coefficients representative of the spectrum of the input speech signals, and for generating quantized linear predictive coding coefficients. A first input speech power determiner is provided, for generating estimates of the power of the input speech signals. A first gain estimator operating on the input speech signals generates a first estimate of the system gain. A synthetic receiver is coupled to the pitch estimator, to the voicing estimator, and to the spectrum analysis and quantization estimator, for generating synthetic receiver signals representing the signals which would be generated by a vocoder receiver having unit gain. A second gain estimator is coupled to the synthetic receiver and to the first input speech power determiner, for comparing the power of corresponding portions of the input speech signals with the synthetic receiver signals, for generating a second estimate of the system gain. An estimated gain signal combiner is coupled to the first and second gain estimators, and to the pitch estimator, for combining a portion of the first estimate of the system gain with a portion of the second estimate of the system gain, in response to the estimated pitch, to thereby generate combined estimated gain. The transmitter also includes at least a vocoder quantized signal combiner coupled to the pitch estimator, to the voicing estimator, to the spectrum analysis and quantization estimator, and to the estimated gain signal combiner, for combining signals representative of the pitch, voicing, spectrum, and combined estimated gain.

A vocoder transmitter according to another aspect of the invention codes speech signals arranged in sequential frames, for transmission of the coded signals over a limited-bandwidth channel to a receiver. The vocoder transmitter includes a pitch estimator coupled to receive the input speech signals, for generating pitch estimates representative of the pitch period of the input speech signals. The transmitter also includes a voicing estimator coupled to receive the input speech signals, for generating estimates of the voicing cutoff frequency of the input speech signals. A spectrum analyzer/quantization estimator is coupled to receive the input speech signals, for generating linear predictive coding coefficients representative of the spectrum of the input speech signals, and for generating quantized linear predictive coding coefficients. A linear predictive coding inverse filter is coupled for receiving the input speech signals and the linear predictive coding coefficients, for producing LPC residual signals by filtering the input speech in response to the linear predictive coding coefficients, A first RMS estimator is coupled to receive the input speech signals, for estimating the power in each frame of the input speech signals, to thereby generate speech frame power signals. A second RMS estimator is coupled to the inverse filter, for estimating the power in each frame of the LPC residual signals, for thereby producing signals representing the RMS value of the LPC residual signals. A synthetic receiver is coupled to receive the pitch, voicing, and quantized linear predictive coding coefficients, and the speech frame power signals, for generating synthetic receiver signals representative of the output of a receiver operating on the pitch, voicing, and quantized linear predictive coding coefficients, and for taking the ratio of the speech frame power signals and the synthetic receiver signals, for thereby generating synthetic receiver gain signals. A combiner/quantizer combines, in response to the pitch estimates, the synthetic receiver gain signals with the signals representing the RMS value of the LPC residual signals, to thereby produce quantized signals for transmission over the channel.

DESCRIPTION OF THE INVENTION

Figure 1:
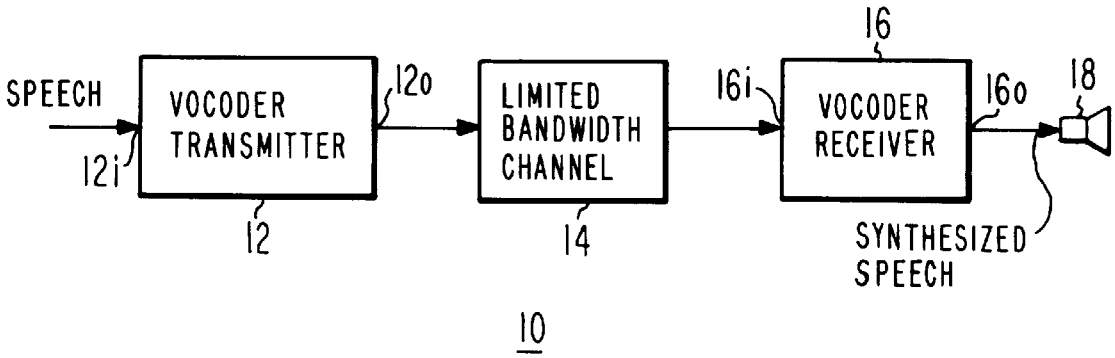
FIG. 1 is a simplified block diagram of a vocoder system, including a transmitter, limited-bandwidth channel, and receiver, for receiving speech signal, and for generating synthesized speech signals for use by utilization means.

FIG. 1 is a simplified block diagram of a vocoder system 10. In FIG. 1, speech signals are applied to the input port 12*i* of a block 12, which represents a vocoder transmitter. Vocoder transmitter 12 evaluates various characteristics of the speech signals applied to its input port 12*i*, and codes the characteristics in a manner which compresses the information. The coded speech signals, which are in the form of a sequence of digital bits, are applied to the input end of a channel 14, which has a bandwidth which is limited. If the bandwidth of the channel 14 were wide, the speech signals could simply be passed through the channel without the need for a transmitter. The coded signals at the output of limited-bandwidth channel 14 cannot be used directly, but are instead applied to the input port 16*i* of a vocoder receiver 16, which converts the coded signals into synthesized speech. The synthesized speech signals are applied from output port 16*o* of receiver 16 to a utilization device, which is illustrated as being a loudspeaker for reproducing the synthesized speech.

Figure 2:
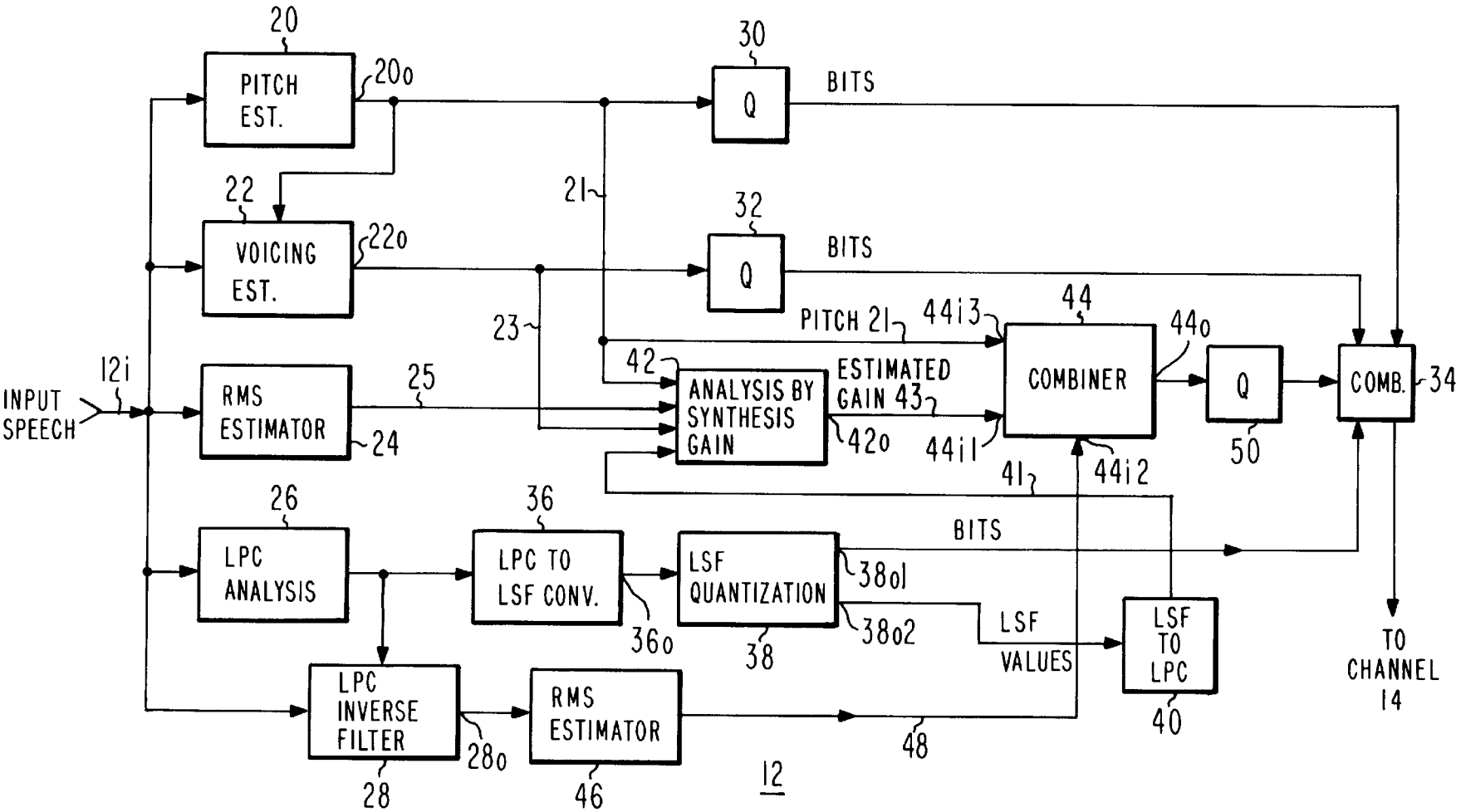
FIG. 2 is a simplified block diagram of the transmitter portion of the vocoder system of FIG. 1.

FIG. 2 is a simplified block diagram of transmitter 12 of FIG. 1, including aspects of the invention. Transmitter 12 processes the input speech signals on a frame-by-frame basis; in one embodiment of the invention, the frames have a duration of 20 msec. The input speech signals, if not already in digital form, are converted into digital form, and are applied by way of input port 12*i*, in parallel, to a pitch estimation block 20, a voicing estimation block 22, a frame power determining block 24, a linear predictive coding analysis block 26, and a linear predictive coding inverse filter 28. Pitch estimator 20 estimates the pitch period of glottal stops inherent in the speech input, and for each frame interval, produces at its output port 20*o*, and on a signal path 21, a digital signal representing the pitch period. Voicing estimator 22 analyzes the speech signals, and produces at its output port 22*o* a digital estimate of the voicing cutoff frequency, as well known to those skilled in the art. In one embodiment, a 3-bit digital word is used to represent the voicing frequency.

Frame power estimator 24 performs an RMS evaluation of the samples in each speech frame, and reports the frame power once per frame at its output port 240 and the associated signal path 25.

In FIG. 2, linear predictive coding (LPC) analysis block 26 produces a set of filter coefficients which, when used in an all-pole filter, produces a filter transfer function which approximates the spectral envelope of the input speech signal, all as known in the art. In a particular embodiment of the invention, ten coefficients are generated per frame. Linear predictive coding inverse filter 28 is an all-zero filter which receives the LPC coefficients from block 26, and sets its transfer function to the inverse of the transfer function of LPC analysis block 26. In this context, the term "inverse" means that the inverse filter 28 has transmission peaks at frequencies corresponding to transmission nulls or valleys in the LPC analysis filter 26, and transmission peaks at those frequencies at which the LPC analysis filter has nulls or valleys. The inverse-filtered signals produced at output port 28*o* of inverse filter 28 are applied to a frame power estimator 46, which determines the power in each frame of inverse-filtered speech signal, and produces an estimated power signal on signal path 48.

The pitch codes produced at the output port 20*o* of pitch estimator 20 are quantized (Q) in a block 30. Block 30 includes a table of permissible values which may be transmitted over the limited-bandwidth channel. Block 30 simply compares the value of pitch period with the permissible values, and selects that one of the permissible values which is deemed to be closest in value to the digitized value determined in block 20. Bits representing the selected or quantized pitch value are coupled to a combiner block 34, in which they are combined with other bits representing other characteristics of the speech, and with synchronizing signals, for transmission over the limited-bandwidth channel.

The signals representing estimates of the speech voicing cutoff frequency, occur once per frame, and are applied from output port 22*o,* by way of a signal path 23, to a quantizer block 32, which performs much the same function as quantizer block 30, except that it operates on the voicing frequency estimates rather than on the pitch estimates. The digital signals representing the voicing table value are applied to combiner 34, for combination with the other signals for transmission over the limited-bandwidth channel.

The linear predictive coding (LPC) analysis coefficients are applied from block 26 to a block 36, which represents LPC-to-LSF (line spectral frequency) conversion. This conversion is for the purpose of generating a second set of monotonically increasing numbers which is more easily coded than the LPC coefficients themselves. Such conversions are well known in the art. The LSF codes produced at output port 36*o* of LPC-to-LSF converter 36 are applied to an LSF quantizer block 38. LSF quantizer block 38 performs "vector" quantization or some other well-known quantization, to generate digital signals at its output port 38*o*1 which identify or index the particular bin or memory location in which the quantized equivalent of the LSF codes from block 36 are found. The digital signals from the bin, representing an index which, in the receiver, points to a bin in which the quantized LSF values reside, are applied from output port 38*o*1 to combiner 34, for combination with the other signals being transmitted over the limited bandwidth path. The quantized line spectral frequencies themselves, which in one embodiment of the invention is in the form of ten additional numbers, is also produced at a second output of block 38, namely at output port 38*o*2. The set of quantized line spectral frequencies from output port 38*o*2 is applied to an LSF-to-LPC converter 40, in which the linear predictive coding coefficients are regenerated (subject, of course, to the quantization performed in block 38).

Figure 3:
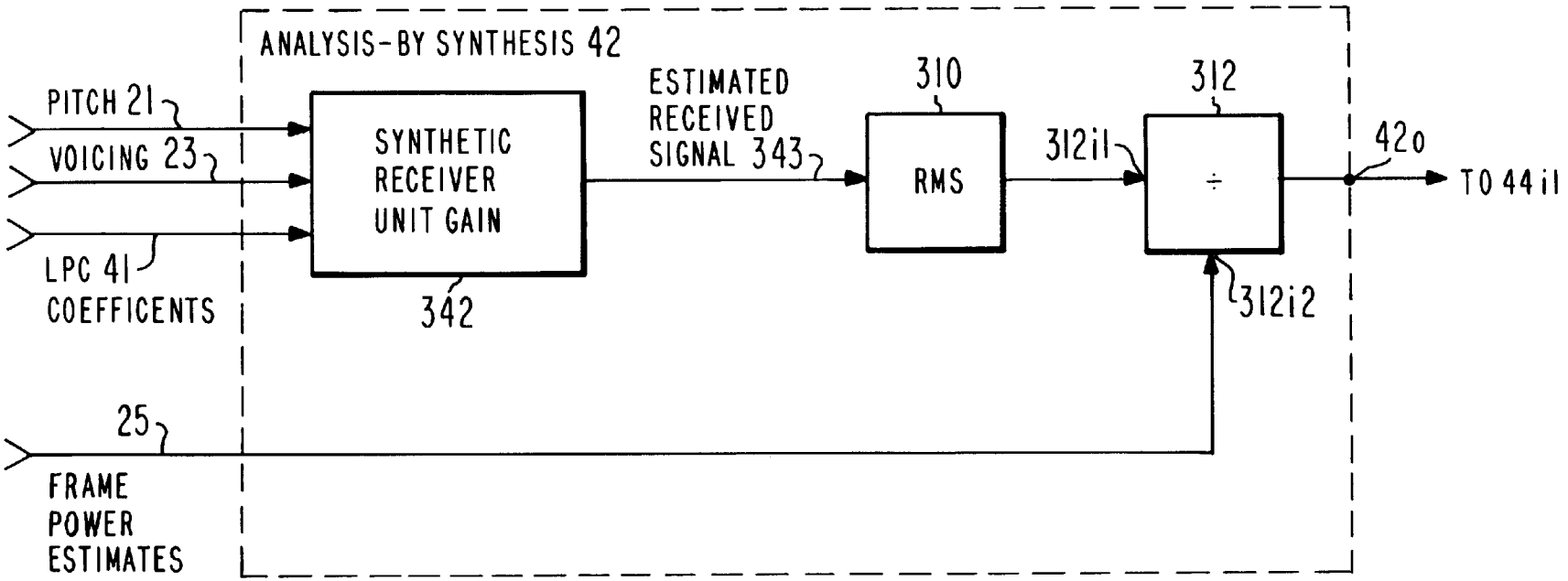
FIG. 3 is simplified block diagram of an analysis-by-synthesis portion of the transmitter of FIG. 2 in accordance with an aspect of the invention.

The reconstituted LPC coefficients are applied from LSF-to-LPC converter 40 of FIG. 2, by way of a signal path 41, to an input port of an analysis-by-synthesis block 42. Analysis-by-synthesis block 42 also receives the pitch estimate signals from output port 20*o* of pitch estimator 20, the voicing estimate signals from output port 22*o* of voicing estimator 22, and the frame power signals from RMS estimator 24. FIG. 3 is a simplified block diagram of analysis-by-synthesis block 42 of FIG. 2.

In FIG. 3, analysis-by-synthesis block 42 includes what is essentially a "synthetic" receiver 342, located in the transmitter, which produces a replica of that synthesized signal which a receiver would produce, if the receiver were to receive the voicing, pitch, and quantized spectrum estimates, and operated at unit gain. This synthesized replica of the received signal, in turn, allows the gain of the overall system to be estimated, so that an estimated gain signal can be generated at the transmitter which, when operated on by the receiver, will properly replicate the applied speech signals. Details of the synthetic receiver portion 342 of analysis-by-synthesis block 42 of FIG. 3 are not necessary for purposes of this invention, because all of the techniques which are required are known from the vocoder receiver art. The synthetic receiver portion 342 of block 42, as mentioned, produces what amounts to a replica or estimate of the signal generated at the output of the receiver, subject to certain anomalies, and also subject to the unity-gain requirement. The estimated received signal is applied from block 342 over a signal path 343 to a power estimating block 310, which determines the RMS power contained in each frame of the estimated received speech signal. The power information for each frame of the output signal of the synthetic receiver can be compared with the power of the corresponding frame of the actual input speech signal, to make an estimate of the overall gain of the vocoder as a whole. The comparison is performed by a ratio or division (÷) block 312, which receives at its first input port 312*i*1 the estimated received signal frame power signals, and receives at its second input port 312*i*2 the corresponding frame power signals determined from the inverse filter block 28 of FIG. 2. The ratio of these two frame power estimates represents the analysis-by-synthesis estimated gain ratio.

It was discovered that, while the system gain estimated by RMS power estimator 46 of FIG. 2 provided good performance for women's voices, it tended not to sound as good for men's voices. On the other hand, the gain estimate provided by the analysis-by-synthesis block 42 worked well with men's voices, but tended to produce "explosions" in the synthesized reproduction of women's voices. Since men's and women's voices tend to differ in pitch, an arrangement according to an aspect of the invention switches over between the analysis-by-synthesis gain estimate from block 42 and the RMS power estimate from block 46 in response to the pitch of the speech signal.

Figure 4:
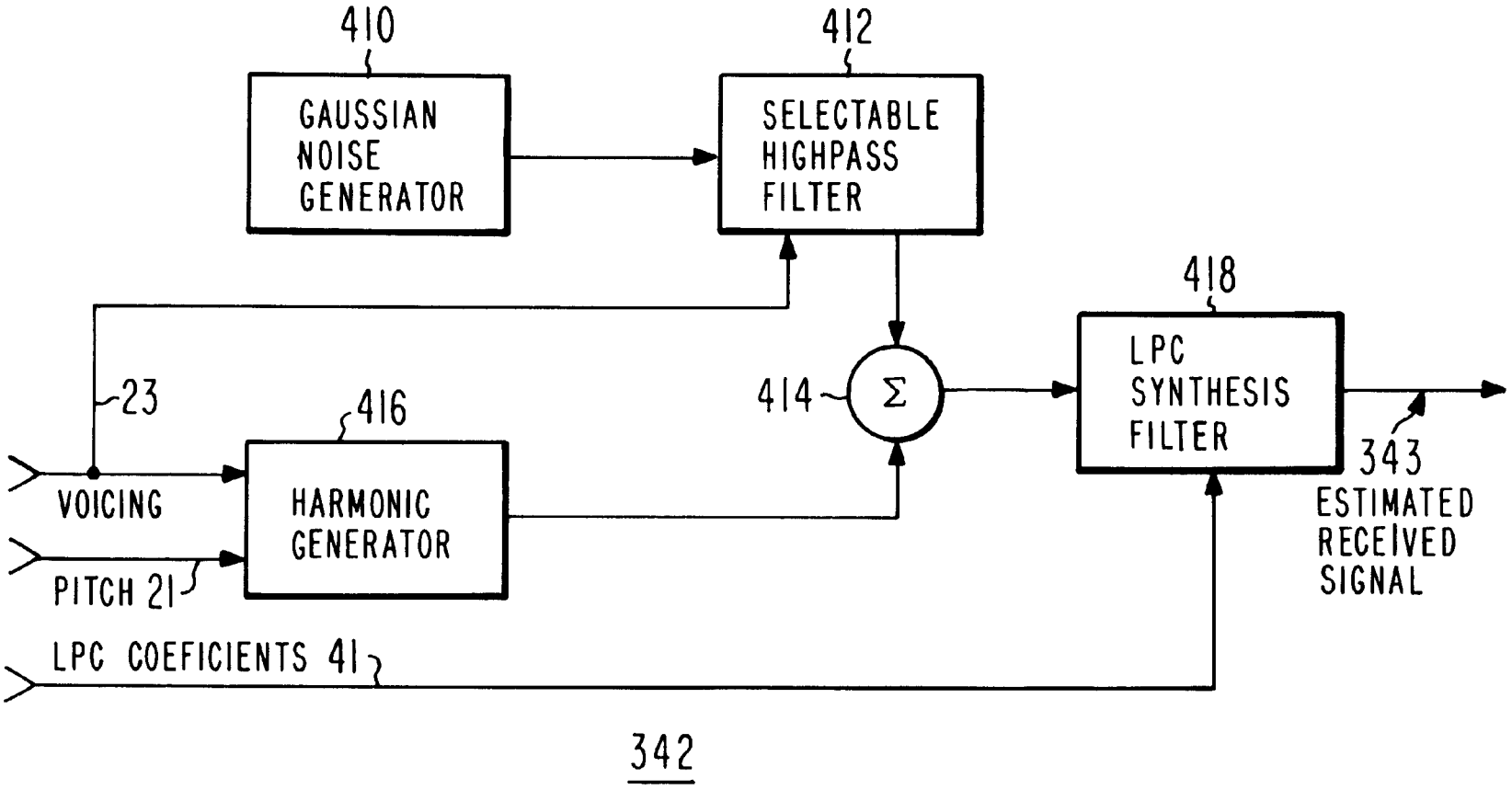
FIG. 4 is a simplified block diagram of a synthetic receiver portion of the diagram of FIG. 3.

For completeness, FIG. 4 illustrates one possible embodiment of the synthetic receiver 342 of FIG. 3. In FIG. 4, a Gaussian noise generator 410 generates white noise, which is applied to a selectable highpass filter, the cutoff frequency of which is controlled by the voicing signals applied over signal path 23. The high-pass filter cuts off the lower-frequency components of the Gaussian noise, and applies the remaining noise to an input port of a summing (Σ) block 414. A harmonic generator 416 receives the voicing signals over signal path 23 and the pitch signals over signal path 21, and generates a fundamental-frequency sinusoidal signal at a frequency established by the pitch period, and also generates harmonics thereof. The sinusoidal fundamental-frequency signals, and the harmonics of those signals, are applied to a second input port of summing block or circuit 414. Summing circuit 414 combines the two signals to produce unit-gain sinusoidal and unvoiced or noise signals, which are applied to an LPC spectrum shaping filter 418. Filter 418 receives the LPC coefficients over signal path 41, and shapes the combined signals from summing circuit 414 in accordance therewith, to thereby produce the synthetic or estimated received signals.

The estimated gain signals produced at output port 42*o* of analysis-by-synthesis block 42 of FIG. 2 are applied to an input port 44*i*1 of a combiner 44, which combines the analysis-by-synthesis estimated gain signals from block 42 with the estimated gain signals applied over signal path 48 to its second input port 44*i*2, under the control of the estimated pitch signals applied to its input port 44*i*3. The combined gain signals produced by combiner block 44 at its output port 44*o* are applied to a quantizer 50, which performs the same general type of quantizing as that performed by blocks 30 or 32. The resulting quantized gain estimate signals are applied to multiplexing combiner 34, for combination of the quantized estimated gain signals with the quantized pitch, voicing, and spectrum signals. The output of multiplexing combiner block 34 is made available to the input end of limited-bandwidth channel 14 of FIG. 1.

Figure 5:
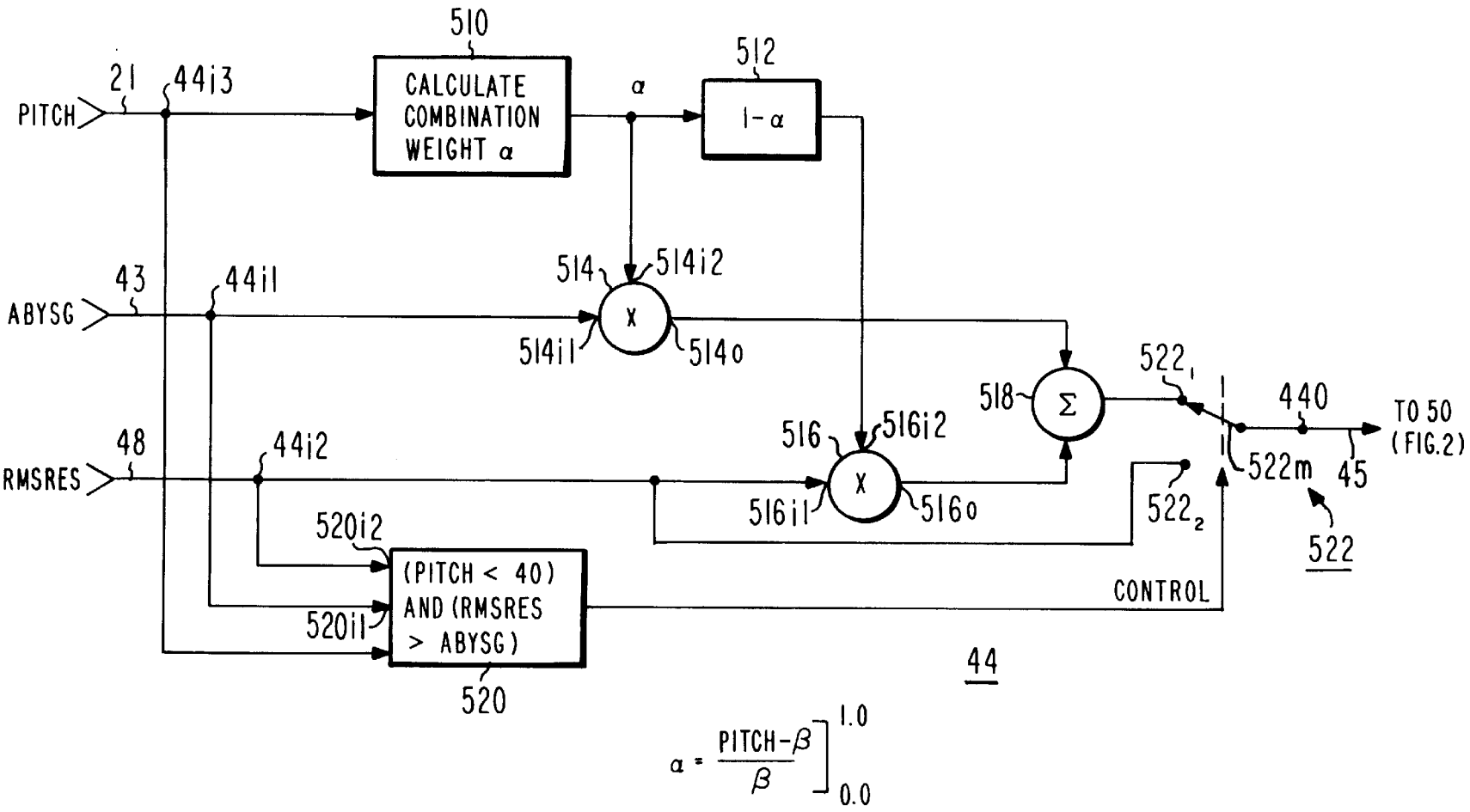
FIG. 5 is a simplified block diagram of an estimated gain combining arrangement of the system of FIG. 2.

FIG. 5 illustrates details of combiner block 44 of FIG. 2. In FIG. 5, the analysis-by-synthesis frame-by-frame gain estimate signals are applied by way of signal path 43 and input port 44*i*1 to a first input port 514*i*1 of a multiplier 514 and to an input port 52*oi*1 of a comparator block 520. The frame-by-frame estimated LPC residual (rmsres) gain, as determined by estimator 46 of FIG. 2 from the inverse-filtered input speech signal, is applied by way of signal path 48 and input port 44*i*2 to a first input port 516*i*1 of a second multiplier 516, to a second input port 520*i*2 of comparator 520, and to a terminal $\mathbf{522}_2$ of a single-pole, double-throw switch represented by a mechanical switch symbol 522. The pitch signals are applied by way of signal path 21 and input port 44*i*3 to a third input port 520*i*3 of comparator block 520 and to a block 510. Block 510 represents calculation of a combining weight α, according to $$\alpha = \frac{\text{pitch} - \beta}{\beta} \qquad 2$$

with α being limited to lie within the range of 0.0 and 1.0, the pitch having units of sample lags, and β having a constant value, which in a particular embodiment of the invention is a value of 30. This creates a value of α which decreases as the pitch, measured in sample lags, decreases. The magnitude of a is applied from block 510 to a second input port of first multiplier 514, so that the multiplier representing analysis-by-synthesis gain increases with increasing pitch period, and decreases with decreasing pitch period. The multiplied analysis-by-synthesis gain produced at output port 514*o* of multiplier 514 is applied to an input port of summing (Σ) circuit 518. The factor α produced by block 510 is also applied to the input of a block 512, which performs the simple subtraction (1−α). The difference signal is applied from block 512 to a second input port 516*i*2 of multiplier 516, so that the output of multiplier 516 at its output port 516*o*is the frame-by-frame rms residual power or gain signal from block 46 of FIG. 1, multiplied by (1−α). The multiplied signals from output ports 514*o* and 516*o* of multipliers 514 and 516, respectively, are applied to input ports of summing circuit 518, and are combined therein to generate an overall gain estimate, which is applied to a terminal $\mathbf{522}_1$ of switch 522. The factors a and (1α) are such that for any value of a, the sum or total of the multiplied gain estimates equals unity. Put another way, if the multiplier for one of the input gain estimates is unity, the multiplier for the other one of the input gain estimates is zero, with a gradation or proportional contribution from each gain estimate for intermediate values of multipliers.

Comparator 520 compares the magnitude of the pitch applied to input port 44*i*3 of FIG. 5 with a threshold value, which in the particular illustrated embodiment is the value 40, and also compares the rmsres amplitude applied to input port 44*i*2 with the analysis-by-synthesis gain value applied to input port 44*i*2, and produces a control signal for operating the "movable" portion 522*m* of switch 522 to its alternate position (not illustrated) upon the concurrence of (a) pitch period less than 40 and (b) rmsres estimated gain greater than analysis-by-synthesis gain. This has the effect of using the melded gain value produced at the output of summer 518 for all conditions except those to which the comparator 520 responds, and using the rmsres gain estimate in response to the activation of comparator 520. That one of the gains selected by switch 522 is applied over signal path 45 to quantizer 50 of FIG. 2.

Figure 6:
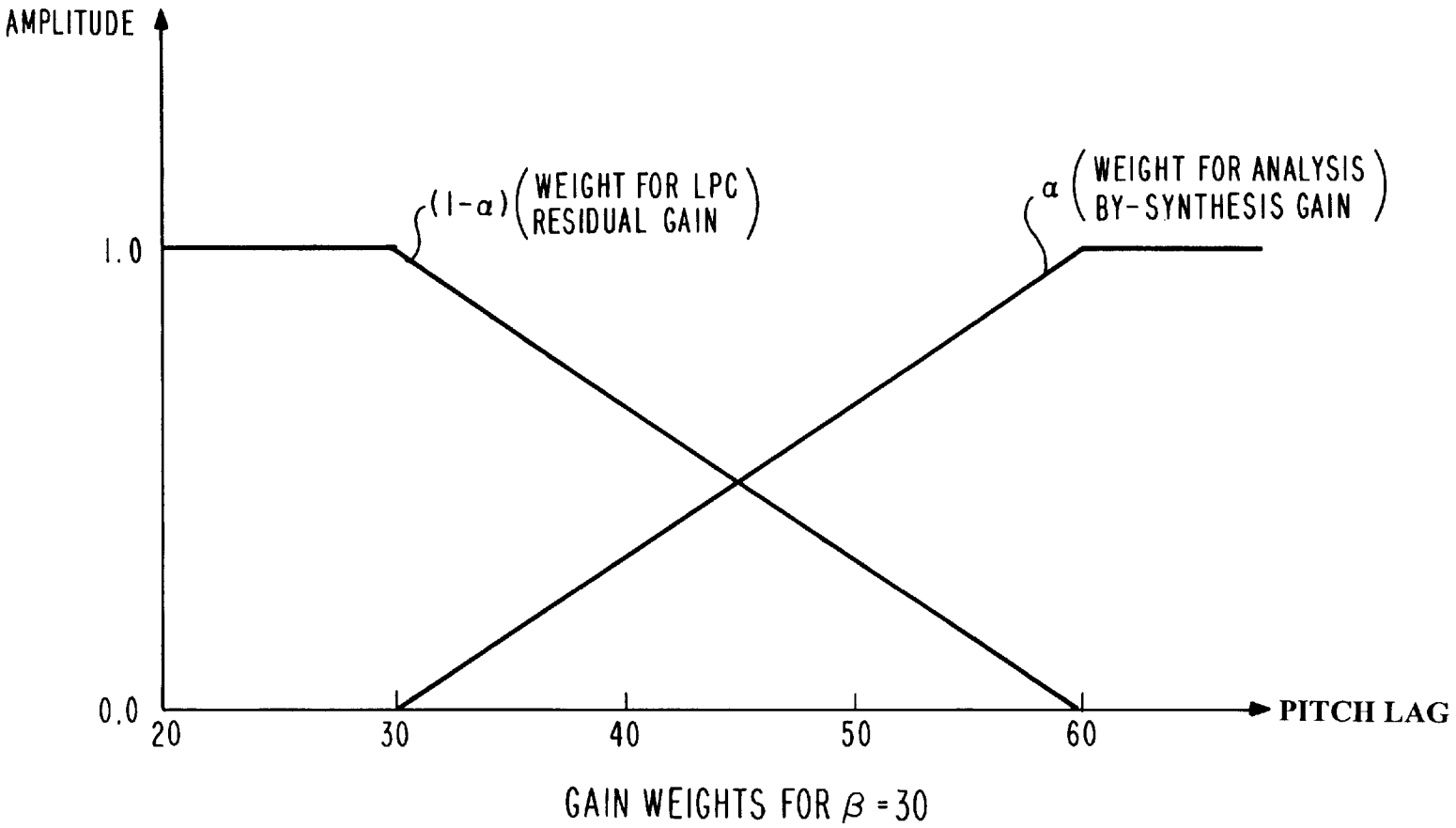
FIG. 6 plots the combining ratio or portion of the two different gain estimates under the control of the combiner of FIG. 5, to produce the combined gain estimate for transmission to the vocoder receiver.

FIG. 6 plots the values of α and 1−α for values of pitch lying between 20 and 65 sample lags. The sum of the two plots equals or totals unity at all illustrated frequencies. As illustrated, the values both equal 0.5 at about 45 sample lags. At periods below about 45 sample lags, the value of (1−α) is the greater, so the contribution toward the summed frame power signals at the output port 44*o* of combining block 44 of FIG. 2 of the frame power signals from RMS estimator block 46 is greater than the contribution of the frame power signals from analysis-by-synthesis block 42. At periods below about 30 sample lags, the combined estimate of frame power is totally derived from the value of (1−α), corresponding to complete control by the frame power estimate by block 46 of FIG. 2. Conversely, at periods above about 45 sample lags, the frame power contributions from analysis-by-synthesis block 42 predominate. At pitch periods above about 60 sample lags, the combined estimate of frame power is totally derived from the value of α, corresponding to complete control by the estimated frame power from analysis-by-synthesis block 42 of FIG. 2.

Other embodiments of the invention will be apparent to those skilled in the art. For example, while the described embodiment produces its coded signals once per frame, there is no necessary relationship between such frame-by-frame coding and the invention; the signals may be produce every other frame, or many coded signals may be produced during each frame. Processing may be performed digitally or in analog form, or by a combination of digital and analog operations. Digital signals may be routed in serial or parallel fashion. The described processing may be performed by software, by hardware, or by firmware. While factor α has been described as a linear function of pitch period, it could instead be nonlinear. While mechanical switch symbols have been used to represent switching functions, those skilled in the art know that this is merely a standardized representation, and that electronic switches are actually used instead of mechanical.

Thus, the invention, in general, relates to a vocoder transmitter (12) which codes input speech signals for transmission over a limited-bandwidth channel (14) to a vocoder receiver (16). The transmitter (12) includes a first system gain estimator (46) which produces a first estimated gain signal. The transmitter also includes an analysis-by-synthesis arrangement (42) which contains, inter alia, a synthetic receiver (342) which generates synthesized received signals which would be generated by the receiver (16) if the receiver (16) had unit gain. The power of the synthesized received signals is compared (312) with the input speech power (24), and the ratio so formed represents a second estimate of the system gain. A combiner (518) combines the first and second estimates of the system gain under control of the estimated pitch to produce the sum gain estimate which is transmitted to the vocoder receiver (16). In a particular embodiment of the invention, the first gain estimate predominates in the sum gain signal at low pitch periods, and the second gain estimate predominates at the higher pitch periods. In a particular embodiment, the cross-over between higher and lower periods is at about 45 sample lags.

More particularly, a vocoder transmitter (12) according to an aspect of the invention codes input speech signals arranged in sequential frames for transmission over a limited-bandwidth channel (14). The transmitter includes a pitch estimator (20) coupled to receive the input speech signals, for generating pitch estimates representative of the pitch period of the input speech signals. A voicing estimator (22) is coupled to receive the input speech signals, for generating estimates of the voicing cutoff frequency of the input speech signals. A spectrum analysis and quantization estimator (26, 36, 38, 40) is coupled to receive the input speech signals, for generating linear predictive coding coefficients representative of the spectrum of the input speech signals, and for generating quantized linear predictive coding coefficients. A first input speech power determiner (24) is provided, for generating estimates of the power of the input speech signals. A first gain estimator (46) operating on the input speech signals generates a first estimate of the system gain. A synthetic receiver (342) is coupled to the pitch estimator (20), to the voicing estimator (22), and to the spectrum analysis and quantization estimator (26, 36, 38, 40), for generating synthetic receiver signals representing the signals which would be generated by a vocoder receiver (16) having unit gain. A second gain estimator (312) is coupled to the synthetic receiver (342) and to the first input speech power determiner (24), for comparing the power of corresponding portions of the input speech signals with the synthetic receiver signals, for generating a second estimate of the system gain. An estimated gain signal combiner (44) is coupled to the first (46) and second (312) gain estimators, and to the pitch estimator (20), for combining a portion of the first estimate of the system gain with a portion of the second estimate of the system gain, in response to the estimated pitch, to thereby generate combined estimated gain. The transmitter also includes at least a vocoder quantized signal combiner (34) coupled (by way of quantizer 30) to the pitch estimator (20), (by way of the quantizer 32) to the voicing estimator, to the spectrum analysis and quantization estimator (26, 36, 38), and to the estimated gain signal combiner (44), for combining signals representative of the pitch, voicing, spectrum, and combined estimated gain.

A particular embodiment of the vocoder transmitter (12) according an aspect of the invention codes speech signals, which are arranged in sequential frames, for transmission of the coded signals over a limited-bandwidth channel (14) to a receiver (16). The vocoder transmitter (12) includes a pitch estimator (20) coupled to receive the input speech signals, for generating pitch estimates representative of the pitch period of the input speech signals. The transmitter (12) also includes a voicing estimator (22) coupled to receive the input speech signals, for generating (at port 220) estimates of the voicing cutoff frequency of the input speech signals. A spectrum analyzer/quantization estimator (26, 36, 38, 40) is coupled to receive the input speech signals, for generating linear predictive coding coefficients representative of the spectrum of the input speech signals, and for generating quantized linear predictive coding coefficients. A linear predictive coding inverse filter (28) is coupled for receiving the input speech signals and the linear predictive coding coefficients, for producing LPC residual signals by filtering the input speech in response to the linear predictive coding coefficients, A first RMS estimator (24) is coupled to receive the input speech signals, for estimating the power in each frame of the input speech signals, to thereby generate speech frame power signals. A second RMS estimator (46) is coupled to the inverse filter (28), for estimating the power in each frame of the LPC residual signals, for thereby producing signals representing the RMS value of the LPC residual signals. An analysis-by-synthesis arrangement (42) including a synthetic receiver (342) is coupled to receive the pitch, voicing, and quantized linear predictive coding coefficients, and the speech frame power signals, for generating synthetic receiver signals representative of the output of a receiver (equivalent to receiver 16) operating on the pitch, voicing, and quantized linear predictive coding coefficients, and for taking the ratio (in block 312) of the speech frame power signals and the synthetic receiver signals, for thereby generating synthetic receiver gain signals. A combiner and quantizer (44, 50) combines, in response to the pitch estimates, the synthetic receiver gain signals with the signals representing the RMS value of the LPC residual signals, and quantizes the signals, to thereby produce quantized signals for transmission over the channel (14).

What is claimed is:

1. A vocoder transmitter for coding input speech signals arranged in sequential frames, for transmission over a limited-bandwidth channel, said transmitter comprising:

pitch estimating means coupled to receive said input speech signals, for generating pitch estimates representative of the pitch period of said input speech signals;

voicing estimating means coupled to receive said input speech signals, for generating estimates of the voicing cutoff frequency of said input speech signals;

spectrum analysis and quantization estimating means coupled to receive said input speech signals, for generating linear predictive coding coefficients representative of the spectrum of said input speech signals, and for generating quantized linear predictive coding coefficients;

first input speech power determining means, for generating estimates of the power of said input speech signals;

first gain estimation means operating on said input speech signals, for generating a first estimate of the system gain;

synthetic receiving means coupled to said pitch estimating means, to said voicing estimating means, and to said spectrum analysis and quantization estimating means, for generating synthetic receiver signals representing the signals which would be generated by a vocoder receiver having unit gain;

second gain estimation means coupled to said synthetic receiving means and to said first input speech power determining means, for comparing the power of corresponding portions of said input speech signals with said synthetic receiver signals, for generating a second estimate of the system gain;

combining means coupled to said first and second gain estimation means, and to said pitch estimation means, for combining a portion of said first estimate of said system gain with a portion of said second estimate of said system gain, in response to the estimated pitch, to thereby generate combined estimated gain; and at least a vocoder quantized signal combining means coupled to said pitch estimating means, to said voicing estimating means, to said spectrum analysis and quantization estimating means, and to said combining means, for combining signals representative of said pitch, voicing, spectrum, and combined estimated gain.

2. A vocoder transmitter for coding speech signals arranged in sequential frames, for transmission over a limited-bandwidth channel, said transmitter comprising:

pitch estimating means coupled to receive said input speech signals, for generating pitch estimates representative of the pitch period of said input speech signals;

voicing estimating means coupled to receive said input speech signals, for generating estimates of the voicing cutoff frequency of said input speech signals;

spectrum analysis and quantization estimating means coupled to receive said input speech signals, for generating linear predictive coding coefficients representative of the spectrum of said input speech signals, and for generating quantized linear predictive coding coefficients;

linear predictive coding inverse filtering means coupled for receiving said input speech signals and said linear predictive coding coefficients, for filtering said input speech in response to said linear predictive coding coefficients, to produce LPC residual signals;

first RMS estimation means coupled to receive said speech signals, for estimating the power in each frame of said input speech signals, to thereby generate speech frame power signals;

second RMS estimation means coupled to said inverse filtering means, for estimating the power in each frame of said LPC residual signals, for thereby producing signals representing the RMS value of said LPC residual signals;

synthetic receiving means coupled to receive said pitch, voicing, and quantized linear predictive coding coefficients, and said speech frame power signals, for generating synthetic receiver signals representative of the output of a receiver operating on said pitch, voicing, and quantized linear predictive coding coefficients, and for taking the ratio of said speech frame power signals and said synthetic receiver signals, for thereby generating synthetic receiver gain signals;

combining and quantizing means for combining said synthetic receiver gain signals with said signals representing the RMS value of said LPC residual signals in response to said pitch estimates, to thereby produce quantized signals for transmission over said channel.

* * * * *